US011885334B2

(12) United States Patent
Hoshino

(10) Patent No.: US 11,885,334 B2
(45) Date of Patent: Jan. 30, 2024

(54) ROTARY COMPRESSOR WITH AN OIL GROOVE FACING THE VANE AND EXPOSED TO A GAP BETWEEN THE VANE AND THE PISTON

(71) Applicant: FUJITSU GENERAL LIMITED, Kanagawa (JP)

(72) Inventor: Shuhei Hoshino, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 17/910,261

(22) PCT Filed: Mar. 30, 2021

(86) PCT No.: PCT/JP2021/013691
§ 371 (c)(1),
(2) Date: Sep. 8, 2022

(87) PCT Pub. No.: WO2021/201034
PCT Pub. Date: Oct. 7, 2021

(65) Prior Publication Data

US 2023/0117903 A1 Apr. 20, 2023

(30) Foreign Application Priority Data

Mar. 30, 2020 (JP) ..... 2020-061246

(51) Int. Cl.
*F04C 29/02* (2006.01)
*F04C 23/00* (2006.01)
*F04C 18/356* (2006.01)

(52) U.S. Cl.
CPC ..... *F04C 29/02* (2013.01); *F04C 18/3564* (2013.01); *F04C 23/001* (2013.01)

(58) Field of Classification Search
CPC ..... F04C 29/02; F04C 18/3564; F04C 23/001
See application file for complete search history.

(56) References Cited

U.S. PATENT DOCUMENTS 4,911,624 A * 3/1990 Bagepalli ..... F04C 18/3564 418/92
5,518,381 A * 5/1996 Matsunaga ..... F04C 29/02 418/60

(Continued)

FOREIGN PATENT DOCUMENTS

JP S57-101391 U 6/1982
JP H03-097593 U 10/1991
JP 2010-121448 A 6/2010

OTHER PUBLICATIONS

Sep. 29, 2022, English translation of International Preliminary Report on Patentability issued for related PCT Application No. PCT/JP2021/013691.

*Primary Examiner* — Mary Davis
(74) *Attorney, Agent, or Firm* — Paratus Law Group, PLLC

(57) ABSTRACT

Provided is a rotary compressor excellent in energy saving performance and reliability by improving sliding performance of a sliding portion and ensuring sealability in a working chamber. An oil groove is formed at a position facing a vane end face on an end plate. The oil groove communicates with an inside of a sealed container, and is exposed in a gap between a leading end surface of a vane and an outer peripheral surface of an annular piston formed when the leading end surface of the vane is in abutment on the outer peripheral surface of the annular piston.

8 Claims, 6 Drawing Sheets

(56) References Cited

U.S. PATENT DOCUMENTS 6,132,195 A * 10/2000 Ikoma ..... F04C 18/3564
418/67
10,294,940 B2 * 5/2019 Hirayama ..... F04C 18/3564

* cited by examiner

ROTARY COMPRESSOR WITH AN OIL GROOVE FACING THE VANE AND EXPOSED TO A GAP BETWEEN THE VANE AND THE PISTON

CROSS REFERENCE TO PRIOR APPLICATION

This application is a National Stage Patent Application of PCT International Patent Application No. PCT/JP2021/013691 (filed on Mar. 30, 2021) under 35 U.S.C. § 371, which claims priority to Japanese Patent Application No. 2020-061246 (filed on Mar. 30, 2020), which are all hereby incorporated by reference in their entirety.

TECHNICAL FIELD

The present invention relates to a rotary compressor for use in a refrigeration cycle of an air conditioner device.

BACKGROUND ART

Rotary compressors include a compression unit that includes an annular cylinder provided with a suction port and a vane groove, an end plate that closes an end portion of the cylinder, an annular piston that is fitted to an eccentric portion of a rotating shaft rotationally driven by a motor and that revolves in the cylinder along a cylinder inner wall of the cylinder to form a working chamber with the cylinder inner wall, and a vane that protrudes into the working chamber from the inside of the vane groove provided in the cylinder and abuts on the annular piston to divide the working chamber into a suction chamber and a compression chamber, in which a discharge port is provided near the vane groove on the end plate to discharge a compressed refrigerant in the compression chamber to an outside of the compression chamber.

In rotary compressors having the above structure, the annular piston revolves in the cylinder and the vane moves in the vane groove as the rotationally driven rotating shaft rotates, so that sliding portions occur between the endplate and the annular piston and at other points in the working chamber. Therefore, it is necessary to take measures to improve sliding performance of the sliding portions.

For the measures, PTL 1 provides a recess in a sidewall portion of a vane to reduce a contact area with end plates, and retains lubricating oil in the recess to improve sliding performance of sliding portions.

CITATION LIST

Patent Literature

PTL 1: JP 2010-121448 A

SUMMARY OF INVENTION

Technical Problem

However, in the conventional technology disclosed in PTL 1, there is no outlet for the lubricating oil retained in the recess of the sidewall portion of the vane to flow out of the recess, due to which sufficient lubricating oil is not supplied to the sliding portions between the end plates and the annular piston. Additionally, since the lubricating oil retained in the recess provided in the sidewall portion of the vane does not flow out, temperature of the lubricating oil retained in the recess rises due to sliding, and viscosity of the lubricating oil decreases, reducing lubricity and sealability in the working chamber.

In view of the above problems, the present invention provides a rotary compressor excellent in energy saving performance and reliability by actively supplying lubricating oil to sliding portions such as an annular piston and a vane in the working chamber of a rotary compressor to improve sliding performance of the sliding portions and ensure sealability in the working chamber.

Solution to Problem

According to one aspect of the present invention, there is provided with a rotary compressor including a motor arranged in a sealed container and a compression unit arranged in the sealed container and driven by the motor, the compression unit including: an annular cylinder configured to include a vane groove opening on an inner peripheral surface of the cylinder and communicating with an inside of the sealed container on an outer peripheral surface side of the cylinder; an end plate configured to close an end face-side opening of the cylinder; an annular piston fitted to an eccentric portion of a rotating shaft rotationally driven by the motor, the annular piston revolving in the cylinder along the inner peripheral surface of the cylinder to form a working chamber with the inner peripheral surface of the cylinder; a vane configured to protrude into the working chamber from an inside of the vane groove and abut on an outer peripheral surface of the annular piston at a leading end surface of the vane to divide the working chamber into a suction chamber and a compression chamber; a discharge port provided on the end plate on the compression chamber side; and a suction port opening on the inner peripheral surface of the cylinder on the suction chamber side, wherein an oil groove is formed at a position facing an end face of the vane on the end plate, one end side of the oil groove communicating with the inside of the sealed container, and an other end side of the oil groove being exposed in a gap between the leading end surface of the vane and the outer peripheral surface of the annular piston formed when the leading end surface of the vane is in abutment on the outer peripheral surface of the annular piston.

Advantageous Effects of Invention

According to the present invention, an oil groove is formed at a position facing the end face of the vane on the end plate, in which one end side of the oil groove communicates with the inside of the sealed container, and the other end side of the oil groove is exposed in a gap between the leading end surface of the vane and the outer peripheral surface of the annular piston formed when the leading end surface of the vane is in abutment on the outer peripheral surface of the annular piston. Therefore, lubricating oil in the sealed container can flow out of the gap between the leading end surface of the vane and the outer peripheral surface of the annular piston formed when the leading end surface of the vane is in abutment on the outer peripheral surface of the annular piston through the oil groove. This allows for lubricating oil supply to sliding portions in the working chamber, enabling improved sliding performance of the sliding portions and ensured sealability in the working chamber.

DESCRIPTION OF EMBODIMENTS

An Example of a rotary compressor according to the present invention is described in detail with reference to the drawings. It should be noted that the present invention is not limited to the Example.

Example

Figure 1:
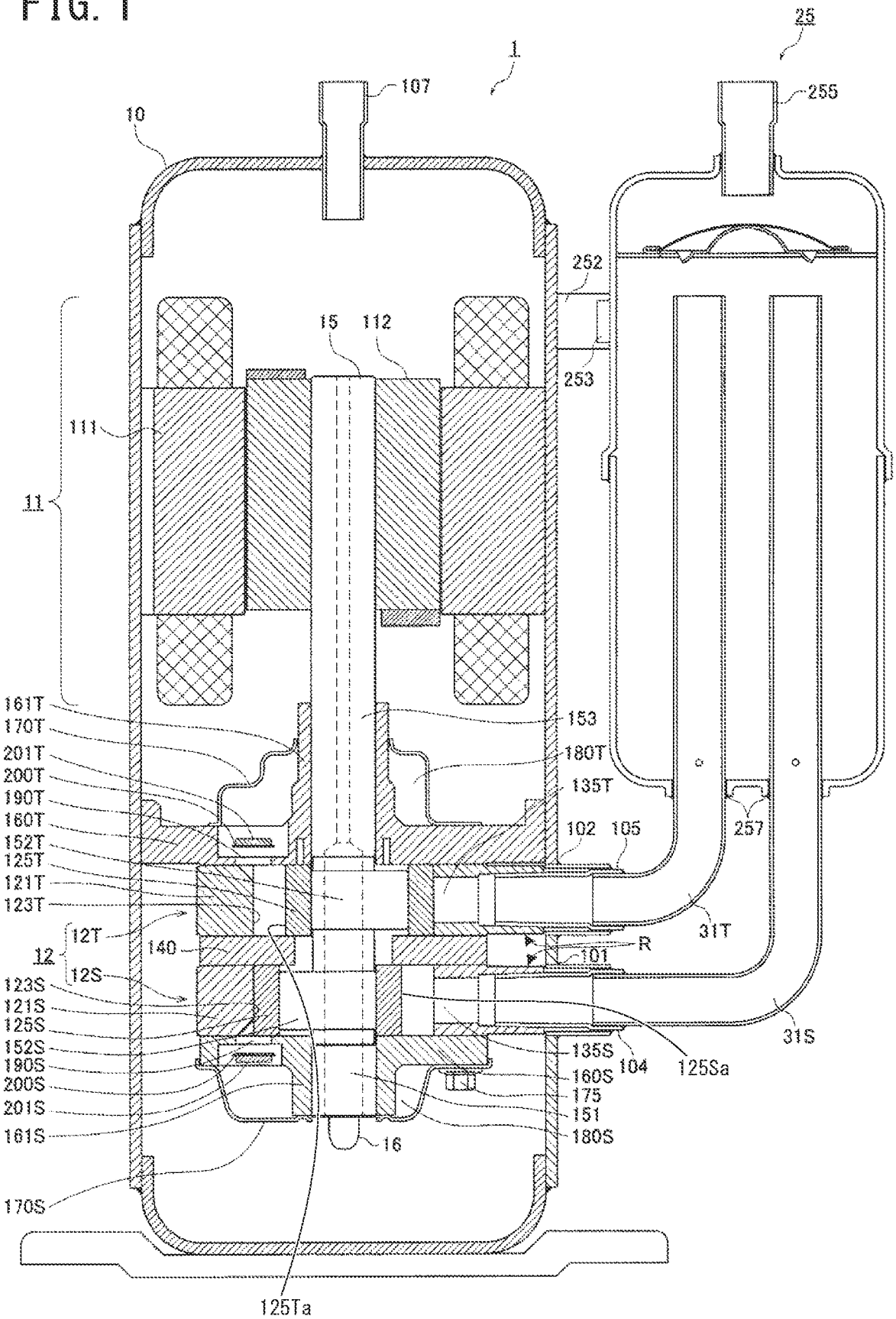
FIG. 1 is a longitudinal cross-sectional view of a rotary compressor.
Figure 2:
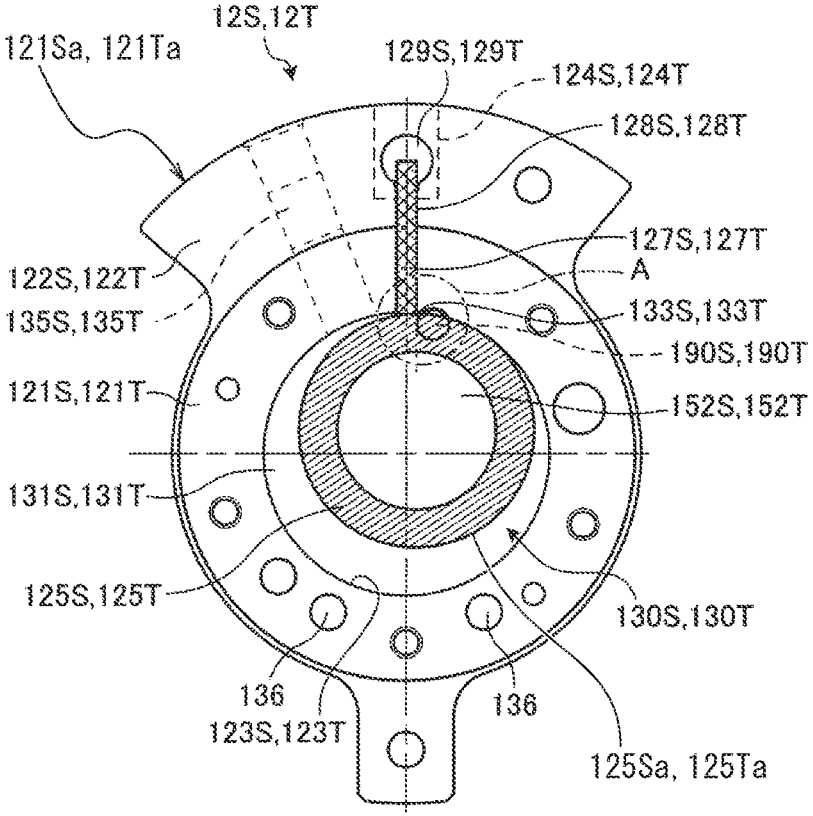
FIG. 2 is a transverse cross-sectional view of a compression unit of the rotary compressor.

FIG. 1 is a longitudinal cross-sectional view illustrating an Example of a rotary compressor according to the present invention. FIG. 2 is a plan view illustrating first and second compression units of Example 4.

As illustrated in FIG. 1, a rotary compressor 1 of the Example includes a compression unit 12 arranged in a lower part of a vertically-positioned cylindrical compressor housing 10 being a sealed container and a motor 11 that is arranged in an upper part of the compressor housing 10 and that drives the compression unit 12 via a rotating shaft 15.

A stator 111 of the motor 11 is formed in a cylindrical shape and is shrink-fitted and fixed to an inner peripheral surface of the compressor housing 10. A rotor 112 of the motor 11 is arranged inside the cylindrical stator 111, and is shrink-fitted and fixed to the rotating shaft 15 that mechanically connects the motor 11 to the compression unit 12.

The compression unit 12 includes a first compression unit 12S and a second compression unit 12T stacked above the first compression unit 12S. As illustrated in FIG. 2, the first compression unit 12S and the second compression unit 12T include an annular first cylinder 121S and an annular second cylinder 121T in which a first suction port 135S and a second suction port 135T, and a first vane groove 128S and a second vane groove 128T are radially provided on a first laterally overhanging portion 122S and a second laterally overhanging portion 122T.

As illustrated in FIG. 2, in the first cylinder 121S and the second cylinder 121T, a first cylinder inner wall (inner peripheral surface) 123S and a second cylinder inner wall (inner peripheral surface) 123T having a circular cross-sectional shape orthogonal to the rotating shaft 15 are formed concentrically with the rotating shaft 15 of the motor 11. Inside the first cylinder inner wall 123S and the second cylinder inner wall 123T are arranged a first annular piston 125S and a second annular piston 125T, respectively, having an outer diameter smaller than a cylinder inner diameter. Between the first and second cylinder inner walls 123S and 123T and outer peripheral surfaces 125Sa and 125Ta of the first and second annular pistons 125S and 125T are formed a first working chamber 130S and a second working chamber 130T that suction, compress, and discharge a refrigerant gas.

In the first cylinder 121S and the second cylinder 121T are formed a first vane groove 128S and a second vane groove 128T in a radial direction and over an entire cylinder height. The first vane groove 128S and the second vane groove 128T are open on the first cylinder inner wall 123S and the second cylinder inner wall 123T, and communicate with an inside of the compressor housing 10 on an outer peripheral surface 121Sa side of the first cylinder 121S and an outer peripheral surface 121Ta side of the second cylinder 121T. A first vane 127S and a second vane 127T each having a flat plate shape are slidably fitted into the first vane groove 128S and the second vane groove 128T.

Figure 6:
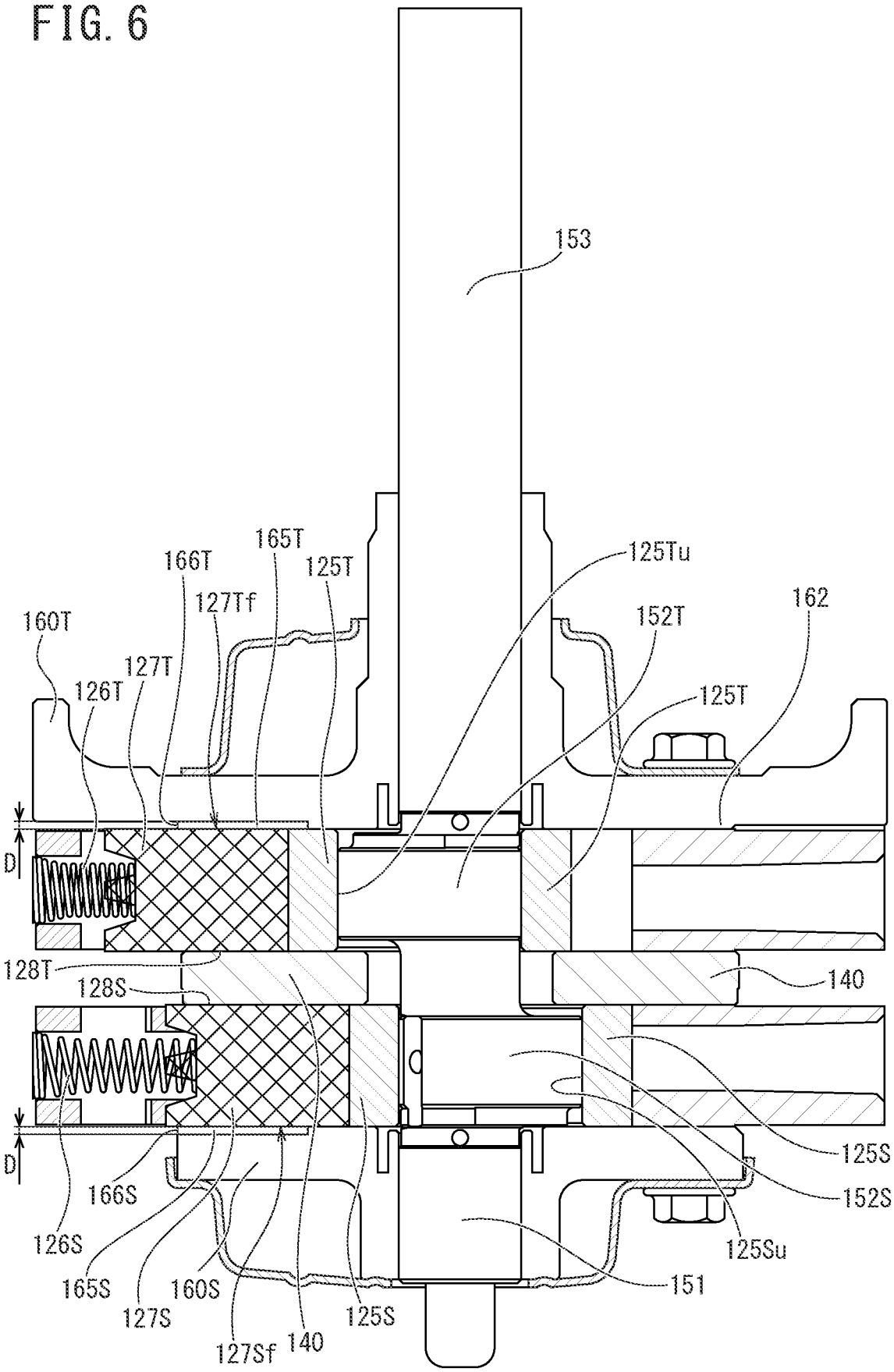
FIG. 6 is a detailed view of a longitudinal cross section of the compression unit.

As illustrated in FIG. 2, at a far end of the first and second vane grooves 128S and 128T are formed a first spring hole 124S and a second spring hole 124T so as to communicate with the first vane groove 128S and the second vane groove 128T from an outer peripheral portion of the first cylinder 121S and the second cylinder 121T. Vane springs 126S and 126T (see FIG. 6) that press a back surface of the first vane 127S and the second vane 127T are inserted into the first spring hole 124S and the second spring hole 124T. When the rotary compressor 1 is started up, the first vane 127S and the second vane 127T protrude from the inside of the first vane groove 128S and the second vane groove 128T into the first working chamber 130S and the second working chamber 130T due to repulsive force of the vane springs. Then, a leading end thereof abuts on the outer peripheral surfaces 125Sa and 125Ta of the first annular piston 125S and the second annular piston 125T, as a result of which the first vane 127S and the second vane 127T divides the first working chamber 130S and the second working chamber 130T into a first suction chamber 131S and a second suction chamber 131T, and a first compression chamber 133S and a second compression chamber 133T.

The first cylinder 121S and the second cylinder 121T are also formed with a first pressure introducing path 129S and a second pressure introducing path 129T that cause the far end of the first and second vane grooves 128S and 128T to communicate with the inside of the compressor housing 10 at an opening portion R illustrated in FIG. 1, introduce a compressed refrigerant gas in the compressor housing 10, and apply back pressure to the first vane 127S and the second vane 127T by pressure of the refrigerant gas.

The first cylinder 121S and the second cylinder 121T are provided with the first suction port 135S and the second suction port 135T that are open on the first cylinder inner wall 123S and the second cylinder inner wall 123T and that cause the first suction chamber 131S and the second suction chamber 131T to communicate with an outside in order to suction a refrigerant from the outside into the first suction chamber 131S and the second suction chamber 131T.

In addition, as illustrated in FIG. 1, between the first cylinder 121S and the second cylinder 121T is arranged an intermediate partition plate 140 that closes an upper end face-side opening of the first cylinder 121S and a lower end face-side opening of the second cylinder 121T to demarcate the first working chamber 130S of the first cylinder 121S and the second working chamber 130T of the second cylinder 121T. At a lower end portion of the first cylinder 121S is arranged a lower end plate 160S that closes a lower end face-side opening of the first cylinder 121S to demarcate the first working chamber 130S of the first cylinder 121S. Note that an outer peripheral surface of the lower endplate 160S faces an internal space in a high-pressure atmosphere state of the compressor housing 10. Additionally, at an upper end portion of the second cylinder 121T is arranged an upper end plate 160T that closes an upper end face-side opening of the second cylinder 121T to demarcate the second working chamber 130T of the second cylinder 121T. The upper end plate 160T includes a large diameter portion having an outer peripheral surface abutting on the inner peripheral surface of the compressor housing 10 and a small diameter portion 162 that is smaller in diameter than the large diameter portion, that protrudes from an end face of the large diameter portion, and that has an end face closing the upper end face-side opening of the second cylinder 121T. An outer peripheral surface of the small diameter portion 162 faces the internal space in the high-pressure atmosphere state of the compressor housing 10.

A sub bearing portion 161S is formed on the lower end plate 160S, and a sub shaft portion 151 of the rotating shaft 15 is rotatably supported by the sub bearing portion 161S. A main bearing portion 161T is formed on the upper end plate 160T, and a main shaft portion 153 of the rotating shaft 15 is rotatably supported by the main bearing portion 161T.

The rotating shaft 15 includes a first eccentric portion 152S and a second eccentric portion 152T that are eccentric with a phase shift of 180° from each other. The first eccentric portion 152S is rotatably fitted to the first annular piston 125S of the first compression unit 12S, and the second eccentric portion 152T is rotatably fitted to the second annular piston 125T of the second compression unit 12T.

When the rotating shaft 15 rotates, the first annular piston 125S and the second annular piston 125T revolve counterclockwise in FIG. 2 in the first cylinder 121S and the second cylinder 121T along the first cylinder inner wall 123S and the second cylinder inner wall 123T, and the first vane 127S and the second vane 127T reciprocate following that. The motions of the first and second annular pistons 125S and 125T and the first and second vanes 127S and 127T continuously change volumes of the first and second suction chambers 131S and 131T and the first and second compression chambers 133S and 133T, and the compression unit 12 continuously suctions, compresses, and discharges a refrigerant gas. A characteristic configuration of the compression unit 12 is described later.

As illustrated in FIG. 1, a lower muffler cover 170S is arranged on an underside of the lower end plate 160S, and a lower muffler chamber 180S is formed between the lower muffler cover 170S and the lower end plate 160S. Then, the first compression unit 12S is open to the lower muffler chamber 180S. In other words, near the first vane 127S on the lower end plate 160S is provided the first discharge port 190S (see FIG. 2) that allows the first compression chamber 133S of the first cylinder 121S to communicate with the lower muffler chamber 180S. The first discharge port 190S is arranged with a reed valve type first discharge valve 200S that prevents backflow of the compressed refrigerant gas.

The lower muffler chamber 180S is a space formed in an annular shape, and is a part of a communication passage that allows a discharge side of the first compression unit 12S to communicate with an inside of the upper muffler chamber 180T through a refrigerant passage 136 (see FIG. 2) that penetrates through the lower end plate 160S, the first cylinder 121S, the intermediate partition plate 140, the second cylinder 121T, and the upper end plate 160T. The lower muffler chamber 180S reduces pressure pulsation of a discharged refrigerant gas. Additionally, a first discharge valve holder 201S for limiting an amount of deflection and opening of the first discharge valve 200S is fixed by rivets together with the first discharge valve 200S so as to overlap with the first discharge valve 200S. The first discharge port 190S, the first discharge valve 200S, and the first discharge valve holder 201S constitute a first discharge valve portion of the lower end plate 160S.

As illustrated in FIG. 1, an upper muffler cover 170T is arranged on an upper side of the upper endplate 160T, and an upper muffler chamber 180T is formed between the upper muffler cover 170T and the upper end plate 160T. Near the second vane 127T on the upper end plate 160T is provided the second discharge port 190T (see FIG. 2) that allows the second compression chamber 133T of the second cylinder 121T to communicate with the upper muffler chamber 180T. The second discharge port 190T is arranged with a reed valve type second discharge valve 200T that prevents backflow of the compressed refrigerant gas. Additionally, a second discharge valve holder 201T for limiting an amount of deflection and opening of the second discharge valve 200T is fixed by rivets together with the second discharge valve 200T so as to overlap with the second discharge valve 200T. The upper muffler chamber 180T reduces pressure pulsation of the discharged refrigerant. The second discharge port 190T, the second discharge valve 200T, and the second discharge valve holder 201T constitute a second discharge valve portion of the upper end plate 160T.

The first cylinder 121S, the lower end plate 160S, the lower muffler cover 170S, the second cylinder 121T, the upper end plate 160T, the upper muffler cover 170T, and the intermediate partition plate 140 are integrally fastened by a plurality of through bolts 175 and the like. In the compression unit 12 integrally fastened by the through bolts 175 and the like, an outer peripheral portion of the large diameter portion of the upper end plate 160T is secured by spot welding to the compressor housing 10 to fix the compression unit 12 to the compressor housing 10.

On an outer peripheral wall of the cylindrical compressor housing 10, first and second through holes 101 and 102 are provided apart axially and in order from the lower part in order to allow first and second suction pipes 104 and 105 to pass therethrough. In addition, on an outer side portion of the compressor housing 10, an accumulator 25 composed of an independent cylindrical sealed container is held by an accumulator holder 252 and an accumulator band 253.

A system connection pipe 255 connected to an evaporator of a refrigeration cycle is connected to a top part center of the accumulator 25. A bottom through hole 257 provided at a bottom of the accumulator 25 is connected to a first low-pressure connection pipe 31S and a second low-pressure connection pipe 31T, one end of which is extended to an internal upper part of the accumulator 25, and an other end of which is connected to an other end of the first suction pipe 104 and the second suction pipe 105.

The first low-pressure connection pipe 31S and the second low-pressure connection pipe 31T, which guide a low-pressure refrigerant of the refrigeration cycle to the first compression unit 12S and the second compression unit 12T via the accumulator 25, are connected to the first suction port 135S and the second suction port 135T (see FIG. 2) of the first cylinder 121S and the second cylinder 121T via the first suction pipe 104 and the second suction pipe 105 serving as a suction unit. In other words, the first suction port 135S and the second suction port 135T are connected in parallel to the evaporator of the refrigeration cycle.

A discharge pipe 107, which serves as a discharge unit that is connected to the refrigeration cycle and that discharges a high-pressure refrigerant gas to a condenser side of the refrigeration cycle, is connected to a top part of the compressor housing 10. In other words, the first discharge port 190S and the second discharge port 190T are connected to the condenser of the refrigeration cycle.

Lubricating oil is sealed in the compressor housing 10 approximately up to the height of the second cylinder 121T. Additionally, the lubricating oil is sucked up through an oil supply pipe 16 attached to a lower end portion of the rotating shaft 15 by a vane pump (not illustrated) inserted into a lower part of the rotating shaft 15, and circulates through the compression unit 12, lubricating sliding components and sealing minute gaps in the compression unit 12.

Next, an oil groove according to the present invention is described with reference to FIGS. 3 to 6. Note that in the following description, for the common configuration contents, such as the first annular piston 125S and the second annular piston 125T, the "first" and the "second" in the names and the subscripts "S" and "T" in the reference signs may be omitted, and duplicate descriptions thereof may be omitted.

Figure 3:
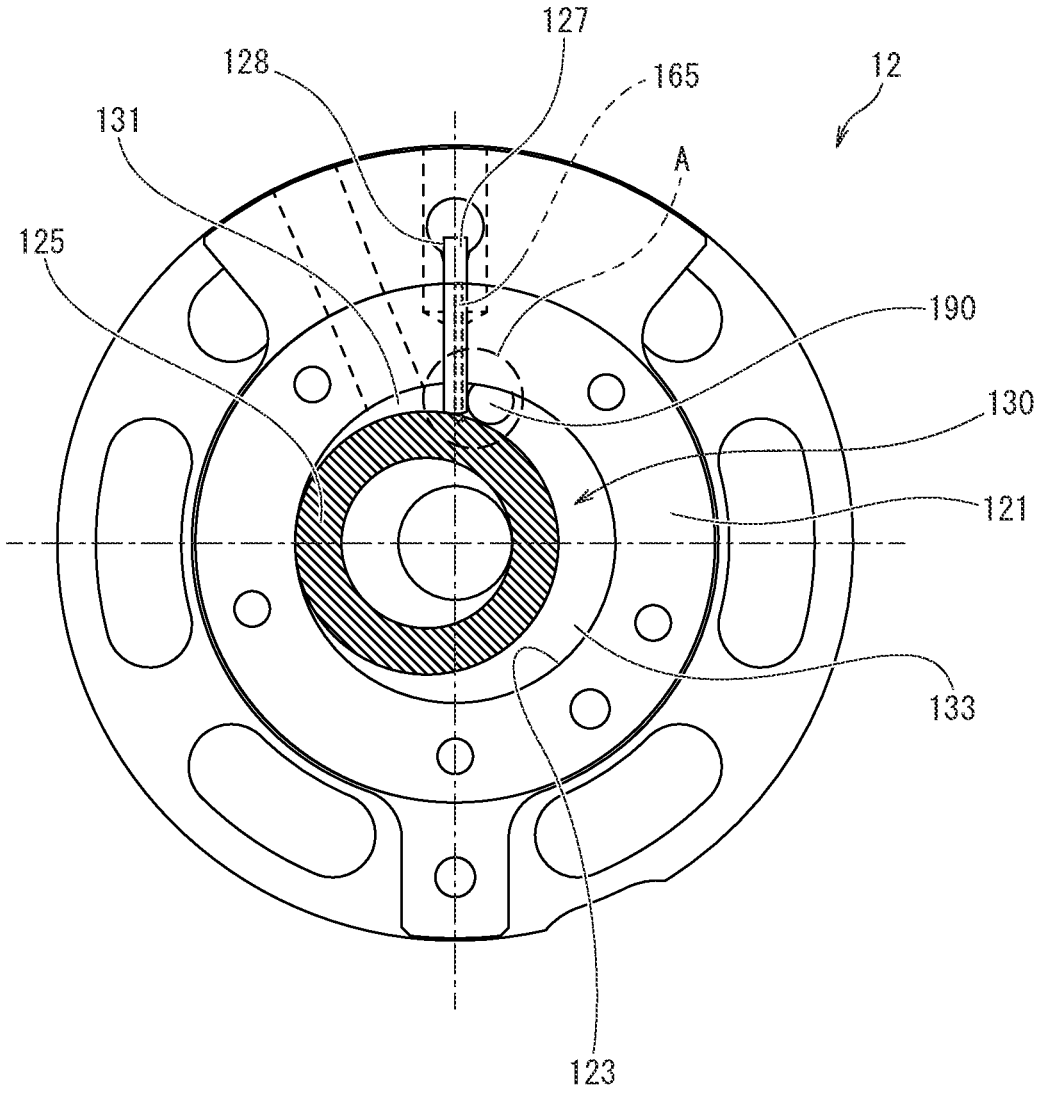
FIG. 3 is a diagram illustrating an annular piston, a vane, and an oil groove of the compression unit.
Figure 4:
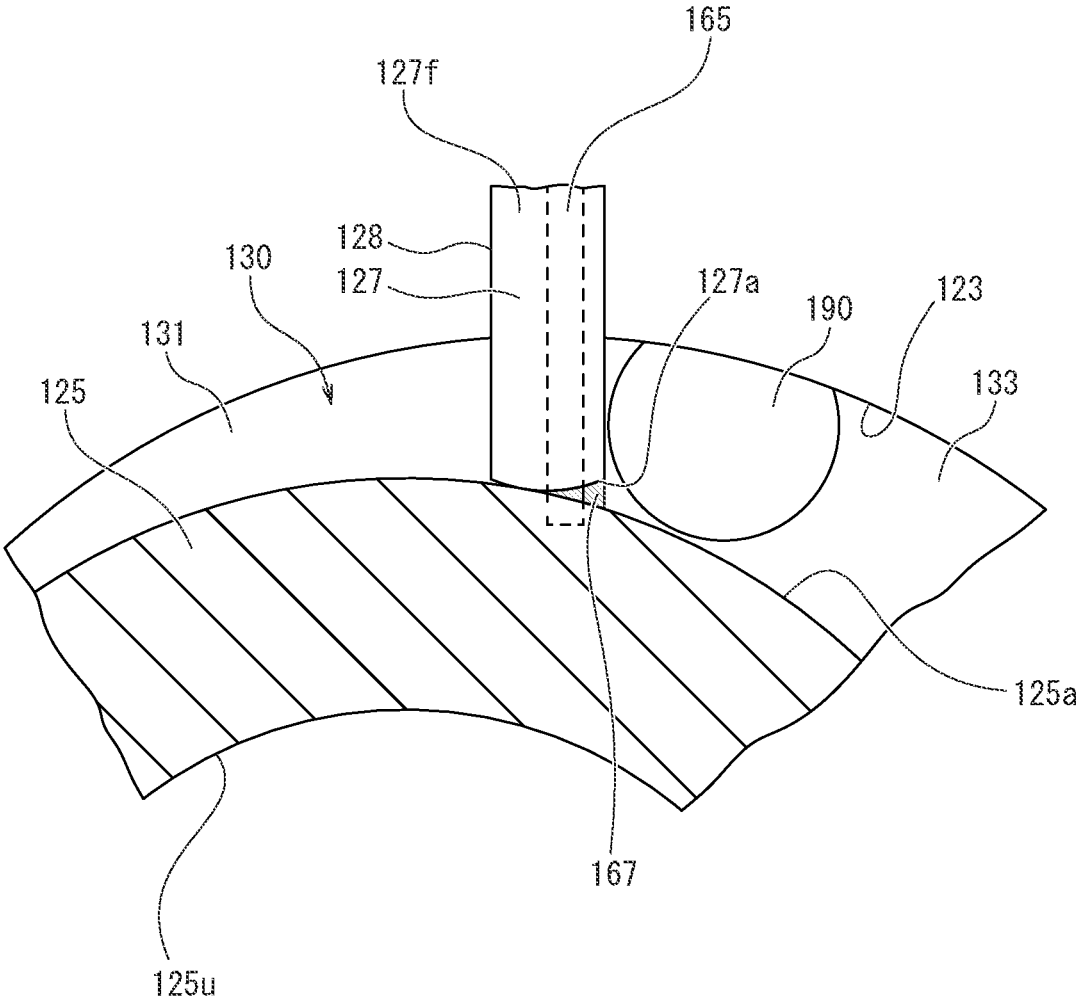
FIG. 4 is an enlarged view of portion A in FIG. 3.
Figure 5:
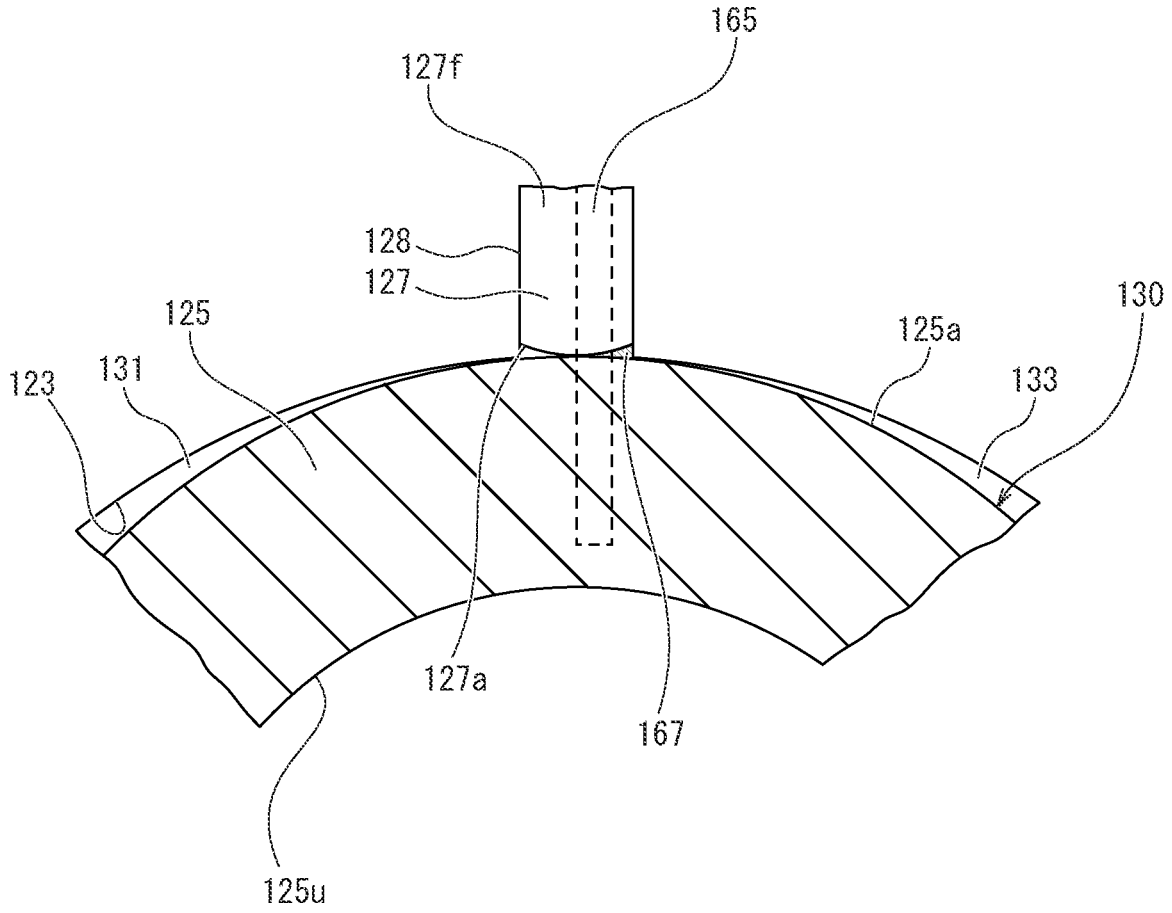
FIG. 5 is a diagram illustrating the annular piston, the vane, and the oil groove at atop dead center of the compression unit.

FIG. 3 is a cross-sectional view illustrating the compression unit 12 of the rotary compressor 1, in which the right side of the working chamber 130 is the compression chamber 133, and the left side thereof is the suction chamber 131. A linearly extending groove-shaped oil groove 165 is formed at a position corresponding to the vane groove 128 on a cylinder 121-side end face of the end plate 160 (the small diameter portion 162 in the case of the upper end plate 160T), i.e., a position where a surface 127*f* of the vane 127 (hereinafter referred to as the end face of the vane 127) facing the end plate 160 faces. One end side of the oil groove 165 is an outer peripheral side of the end plate 160 (the small diameter portion 162 in the case of the upper end plate 160T), and an other end side thereof is a center side of the end plate 160, in which the oil groove 165 radially extends from the center side of the end plate 160 toward the outer peripheral side thereof. The oil groove 165 is narrower in width than the vane groove 128, and is covered widthwise by the end face 127 *f* of the vane 127 fitted slidably in the vane groove 128. Additionally, a widthwise center of the oil groove 165 does not coincide with a widthwise center of the vane groove 128, and the oil groove 165 is located closer to the compression chamber 133 side relative to the widthwise center of the vane groove 128. The oil groove 165 has a depth D of from several μm to several tens of μm.

The one end side of the linearly extending oil groove 165 extends to the outer peripheral surface of the end plate 160 (the outer peripheral surface of the small diameter portion 162 in the case of the upper end plate 160T) facing the internal space of the compressor housing 10, and has an opening portion 166 opening on the outer peripheral surface of the end plate 160. Therefore, the oil groove 165 communicates with the internal space in the high-pressure atmosphere state of the compressor housing 10 via the opening portion 166.

The other end side of the linearly extending oil groove 165 extends into the working chamber 130. The other end side of the oil groove 165 is located at a position such that when the annular piston 125 is at a top dead center position, the other end side thereof is not exposed to an inner periphery 125*u* side of the annular piston 125 and is covered by an end face of the annular piston 125, while when the annular piston 125 is at a bottom dead center position, it is covered by the end face 127*f* of the vane 127. The radially extending oil groove 165 needs only to be exposed in the compression chamber 133 at any position between the top dead center of the annular piston 125 and the bottom dead center thereof, and does not have to be exposed at all times.

A leading end of the vane 127 on the annular piston 125 side has a curved leading end surface 127*a*. Between the leading end surface 127*a* and an outer peripheral surface 125*a* of the annular piston 125, a gap 167 is formed when the leading end surface 127*a* is in abutment on the outer peripheral surface 125*a*, and the oil groove 165 is exposed in the gap 167. In the present Example, the leading end surface 127*a* is curved, but may also be flat.

The opening portion 166 of the oil groove 165 serves as an inlet for lubricating oil, and the gap 167 in which the oil groove 165 is exposed serves as an outlet for the lubricating oil. Accordingly, the lubricating oil in the high-pressure atmosphere state of the compressor housing 10 flows in through the opening portion 166, flows out through the gap 167, and can be supplied to sliding portions.

Since the oil groove 165 is located on the compression chamber 133 side rather than on the widthwise center side of the vane 127, the gap 167 is arranged on the compression chamber 133 side relative to a contact point between the leading end surface 127*a* and the outer peripheral surface 125*a*. By arranging the gap 167 on the compression chamber 133 side, a pressure difference between the opening portion 166 and the gap 167 does not become too large, which can prevent inflow of a large amount of a refrigerant. In addition, in the present Example, the entire oil groove 165 is located on the compression chamber 133 side rather than on the widthwise center side of the vane 127 to arrange the gap 167 on the compression chamber 133 side relative to the contact point between the leading end surface 127*a* and the outer peripheral surface 125*a*. However, as long as the gap 167 is located on the compression chamber 133 side relative to the contact point between the leading end surface 127*a* and the outer peripheral surface 125*a*, the oil groove 165 may be arranged, for example, diagonally with respect to the vane 127 to arrange the gap 167 on the compression chamber 133 side without locating the entire oil groove 165 on the compression chamber 133 side rather than on the widthwise center side of the vane 127.

Additionally, in the present Example, the gap 167 is arranged on the compression chamber 133 side relative to the contact point between the leading end surface 127*a* and the outer peripheral surface 125*a*, but may be arranged on the suction chamber 131 side or arranged on the compression chamber 133 side and the suction chamber 131 side. The arrangement of the gap 167 may be determined so that the pressure difference between pressure at the opening portion 166 and pressure at the gap 167 is suitable for lubricating oil supply.

In addition, in the present Example, the end portion of the oil groove 165 on the end plate center side, which is the other end side thereof, extends into the working chamber 130. However, the end portion on the other end side of the oil groove 165 does not have to be extended into the working chamber 130 as long as the oil groove 165 is exposed in the gap 167 formed when the leading end surface 127*a* is in abutment on the outer peripheral surface 125*a*. For example, even when the end portion on the other end side of the oil groove 165 is located in the vane groove 128 and immediately before the working chamber 130, the oil groove 165 can be exposed in the gap 167 when the annular piston 125 is at the top dead center position as long as the leading end surface 127*a* of the vane 127 is curved. Thus, when the annular piston 125 comes to the top dead center position, the lubricating oil flowing in through the opening portion 166 can flow out through the gap 167.

In the present Example, the oil groove 165 is formed not on the intermediate partition plate 140 but on the end face of the end plate 160S that closes the lower end portion-side opening of the cylinder 121S and the end face of the end plate 160T that closes the upper end portion-side opening of the cylinder 121T. However, the oil groove 165 may be formed not on the end plates 160S and 160T but on end faces of the intermediate partition plate 140 that closes an upper end portion-side opening of the cylinder 121S and a lower end portion-side opening of the cylinder 121T. However, for a reason described below, the oil groove 165 is preferably formed on the end face of the end plate 160S closing the lower end portion-side opening of the cylinder 121S and the end face of the end plate 160T closing the upper end portion-side opening of the cylinder 121T.

In FIG. 1, the respective discharge ports 190S and 190T of the two compression units 12S and 12T are provided on the left side with respect to the rotating shaft 15. Therefore, a force due to the refrigerant compressed by the rotation of the annular pistons 125S and 125T acts on the eccentric portions 152S and 152T via the annular pistons 125S and 125T from the left side. Since the rotating shaft 15 is supported by the sub bearing portion 161S under the first compression unit 12S and the main bearing portion 161T on the second compression unit 12T, the main shaft portion 153 is deformed to be convex rightward. Along with the deformation of the main shaft portion 153, a leading end side (the first annular piston 125S side) of an end face 127Sf of the first vane 127S arranged near the first discharge port 190S of the first compression unit 12S tilts so as to come into partial contact with the lower end plate 160S. Similarly, a leading end side (the second annular piston 125T side) of an end face 127Tf of the second vane 127T arranged near the second discharge port 190T of the second compression unit 12T tilts so as to come into partial contact with the upper end plate 160T. Accordingly, preferably, the oil groove 165 is arranged on the lower end plate 160S with which the leading end side of the first vane 127S comes into partial contact, and is also arranged on the upper end plate 160T with which the leading end side of the second vane 127T comes into partial contact.

While the present invention has been described with reference to the limited number of embodiments, the scope of rights of the present invention is not limited thereto. Modifications of the embodiments based on the above disclosure are obvious to those skilled in the art.

REFERENCE SIGNS LIST

1: Rotary compressor
10: Compressor housing (sealed container)
11: Motor
12S, T: Compression unit
15: Rotating shaft
121S, T: Cylinder
125S, T: Annular piston
127S, T: Vane
127Sf, Tf: End face of vane
128S, T: Vane groove
130S, T: Working chamber
131S, T: Suction chamber
133S, T: Compression chamber
135S, T: Suction port
152S, T: Eccentric portion
160S, T: End plate
165S, T: Oil groove
167S, T: Gap
190S, T: Discharge port

The invention claimed is:

1. A rotary compressor comprising a motor arranged in a sealed container and a compression unit arranged in the sealed container and driven by the motor, the compression unit including:

an annular cylinder configured to include a vane groove opening on an inner peripheral surface of the cylinder and communicating with an inside of the sealed container on an outer peripheral surface side of the cylinder;

an end plate configured to close an end face-side opening of the cylinder;

an annular piston fitted to an eccentric portion of a rotating shaft rotationally driven by the motor, the annular piston revolving in the cylinder along the inner peripheral surface of the cylinder to form a working chamber with the inner peripheral surface of the cylinder;

a vane configured to protrude into the working chamber from an inside of the vane groove and abut on an outer peripheral surface of the annular piston at a leading end surface of the vane to divide the working chamber into a suction chamber and a compression chamber;

a discharge port provided on the end plate on the compression chamber side; and a suction port opening on the inner peripheral surface of the cylinder on the suction chamber side, wherein an oil groove is formed at a position facing an end face of the vane on the end plate, one end side of the oil groove communicating with the inside of the sealed container, and an other end side of the oil groove being exposed in a gap between the leading end surface of the vane and the outer peripheral surface of the annular piston formed when the leading end surface of the vane is in abutment on the outer peripheral surface of the annular piston, and the gap in which the oil groove is exposed is on the compression chamber side of the working chamber.

2. The rotary compressor according to claim 1, wherein the other end side of the oil groove is exposed in the working chamber.

3. The rotary compressor according to claim 2, wherein an end portion on the other end side of the oil groove is covered by the annular piston at a top dead center position.

4. The rotary compressor according to claim 3, wherein the compression unit includes a first compression unit arranged on a lower side and a second compression unit arranged on an upper side across an intermediate partition plate in between, the intermediate partition plate closing an upper end portion-side opening of the cylinder in the first compression unit and a lower end portion-side opening of the cylinder in the second compression unit, and the end plate includes a lower end plate configured to close a lower end portion-side opening of the cylinder in the first compression unit and an upper end plate configured to close an upper end portion-side opening of the cylinder in the second compression unit, the lower end plate and the upper end plate being formed with the oil groove.

5. The rotary compressor according to claim 2, wherein the compression unit includes a first compression unit arranged on a lower side and a second compression unit arranged on an upper side across an intermediate partition plate in between, the intermediate partition plate closing an upper end portion-side opening of the cylinder in the first compression unit and a lower end portion-side opening of the cylinder in the second compression unit, and the end plate includes a lower end plate configured to close a lower end portion-side opening of the cylinder in the first compression unit and an upper end plate configured to close an upper end portion-side opening of the cylinder in the second compression unit, the lower end plate and the upper end plate being formed with the oil groove.

6. The rotary compressor according to claim 1, wherein the compression unit includes a first compression unit arranged on a lower side and a second compression unit arranged on an upper side across an intermediate partition plate in between, the intermediate partition plate closing an upper end portion-side opening of the cylinder in the first compression unit and a lower end portion-side opening of the cylinder in the second compression unit, and the end plate includes a lower end plate configured to close a lower end portion-side opening of the cylinder in the first compression unit and an upper end plate configured to close an upper end portion-side opening of the cylinder in the second compression unit, the lower end plate and the upper end plate being formed with the oil groove.

7. The rotary compressor according to claim 1, wherein an end portion on the other end side of the oil groove is covered by the annular piston at a top dead center position.

8. The rotary compressor according to claim 7, wherein the compression unit includes a first compression unit arranged on a lower side and a second compression unit arranged on an upper side across an intermediate partition plate in between, the intermediate partition plate closing an upper end portion-side opening of the cylinder in the first compression unit and a lower end portion-side opening of the cylinder in the second compression unit, and the end plate includes a lower end plate configured to close a lower end portion-side opening of the cylinder in the first compression unit and an upper end plate configured to close an upper end portion-side opening of the cylinder in the second compression unit, the lower end plate and the upper end plate being formed with the oil groove.

* * * * *